US005967478A

United States Patent [19]

Tynes

[11] Patent Number: 5,967,478

[45] Date of Patent: Oct. 19, 1999

[54] WINDOW SHELF FOR SUPPORTING AN AIR CONDITIONER

[76] Inventor: Tim Tynes, 10 Lawnfair St. #1, Worcester, Mass. 01602

[21] Appl. No.: 08/997,968

[22] Filed: Dec. 24, 1997

[51] Int. Cl.[6] ..... A47G 29/02

[52] U.S. Cl. ..... 248/241; 98/94.2; 248/208

[58] Field of Search ..... 248/241, 208, 248/236, 678, 351, 250, 235, 346.07; 62/262; 108/47; 98/942

[56] References Cited

U.S. PATENT DOCUMENTS 798,683 9/1905 Ketteman ..... 248/236
1,069,000 7/1913 Giles ..... 248/236
2,332,477 10/1943 Thornley ..... 248/241 X
4,869,451 9/1989 Gordon ..... 248/241 X
5,553,824 9/1996 Dutra, Jr. ..... 248/346.07

*Primary Examiner*—Ramon O. Ramirez

[57] ABSTRACT

An air conditioner support system is provided including a pair of suspenders each with a horizontally oriented member coupled to a respective side of a window. Coupled to the horizontally oriented member is a truss. Next provided is a support plate assembly including a pair of extendible plates. In use, such support plate assembly is engaged with the suspenders for supporting an air conditioner thereon.

11 Claims, 4 Drawing Sheets

FIG. 4
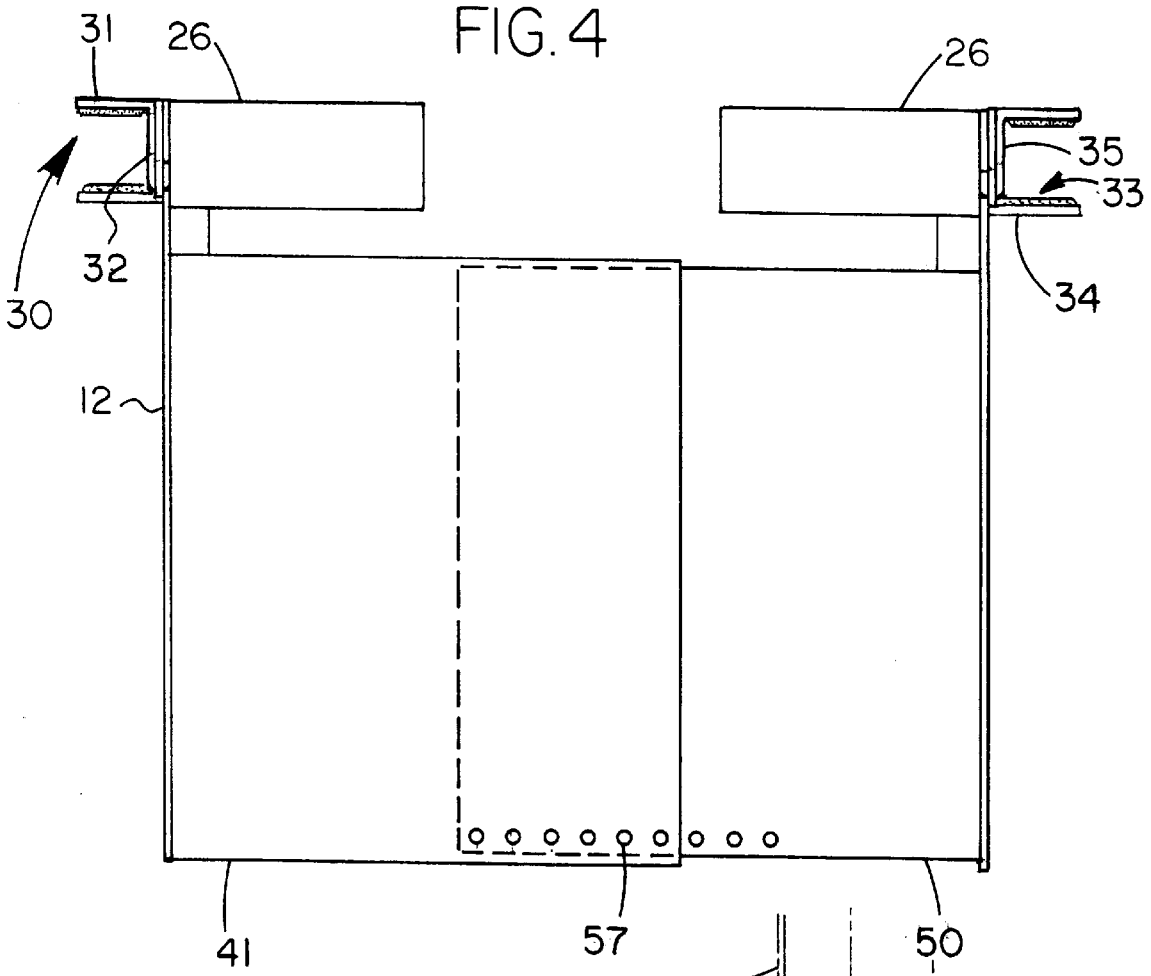
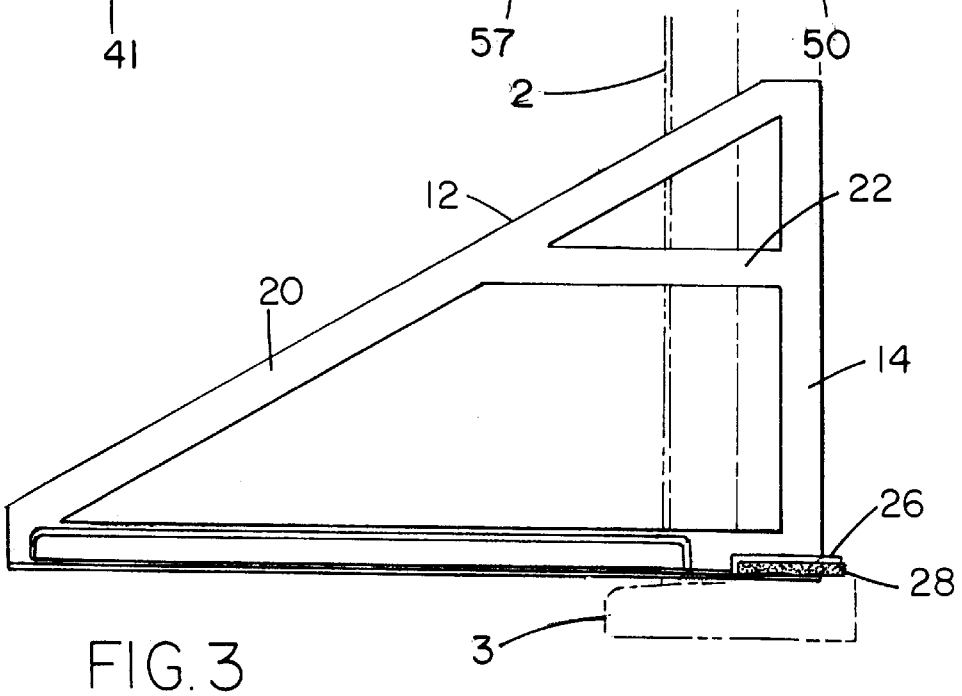
FIG. 3

WINDOW SHELF FOR SUPPORTING AN AIR CONDITIONER

BACKGROUND OF THE INVENTION

1. Field of the Invention

The present invention relates to window shelves and more particularly pertains to a new window shelf for allowing the installation of a window shelf from within a house and does not inflict damage by way of tools or fasteners on the window.

2. Description of the Prior Art

The use of window shelves is known in the prior art. More specifically, window shelves heretofore devised and utilized are known to consist basically of familiar, expected and obvious structural configurations, notwithstanding the myriad of designs encompassed by the crowded prior art which have been developed for the fulfillment of countless objectives and requirements.

Known prior art window shelves include U.S. Pat. No. 4,510,852; U.S. Pat. No. 4,869,451; U.S. Pat. Des. 288,570; U.S. Pat. Des. 266,827; U.S. Pat. No. 4,862,812; and U.S. Pat. No. 5,112,015.

While these devices fulfill their respective, particular objectives and requirements, the aforementioned patens do not disclose a new window shelf. The inventive device includes a pair of suspenders are provided each including a vertically oriented member and a horizontally oriented member in the form of an angle iron. The angle iron has a vertical extent with an inboard end perpendicularly coupled to a bottom end of the vertically oriented member and extended outwardly therefrom. Associated therewith is a horizontal extent defining an inwardly extending ledge. Also included is truss having a first end coupled to an outboard end of the angle iron and a second end coupled to a top end of the vertically oriented member. A vertical slot is formed in the vertically oriented member adjacent the top end thereof. A foot is integrally coupled to the horizontal extent of the angle iron adjacent the inboard end thereof. Such foot extends inwardly from the respective angle iron with a pad lining a bottom surface thereof. Next provided is a pair of ears each having an L-shaped configuration. Each ear is defined by a first plate and second plate. The second plate is integrally coupled perpendicularly with respect to the first plate. Further, the second plate has a lip extending therefrom in a direction opposite from that which the first plate extends. In use, the first plate of each ear is coupled on opposite sides of a window with padding situated therebetween. As such, the second plate extends outwardly from a wall in which the window resides and the lip extends inwardly towards the window. By this structure, the slots of the suspenders may be engaged with the lips of the ears such that the feet of the suspenders rest on a window stool. As shown in FIGS. 1 and 2, an extendible support plate assembly is provided including a pair of rectilinear plates. Such plates include a rectilinear first plate with a top face, a bottom face, a front face, and a rear face defining a pair of open ends. Also included is a rectilinear second plate with a top face, a front face, and a rear face defining a pair of open ends and an open bottom. Formed on the top face of both plates is a plurality of linearly aligned apertures. Preferably, such apertures are located adjacent the associated front face of the plates. During use of the present invention, the second plate may be slidably inserted within the first plate such that at least one of the apertures of each plate are aligned thereby allowing the securement of the relative positions of the plates via a pin. Note FIG. 2. This allows the support plate assembly to be supported by the ledges of the suspenders.

In these respects, the window shelf according to the present invention substantially departs from the conventional concepts and designs of the prior art, and in so doing provides an apparatus primarily developed for the purpose of allowing the installation of a window shelf from within a house and does not inflict damage by way of tools or fasteners on the window.

SUMMARY OF THE INVENTION

In view of the foregoing disadvantages inherent in the known types of window shelves now present in the prior art, the present invention provides a new window shelf construction wherein the same can be utilized for allowing the installation of a window shelf from within a house and does not inflict damage by way of tools or fasteners on the window.

The general purpose of the present invention, which will be described subsequently in greater detail, is to provide a new window shelf apparatus and method which has many of the advantages of the window shelves mentioned heretofore and many novel features that result in a new window shelf which is not anticipated, rendered obvious, suggested, or even implied by any of the prior art window shelves, either alone or in any combination thereof.

To attain this, the present invention generally comprises a pair of suspenders are provided each including a vertically oriented member and a horizontally oriented member in the form of an angle iron. The angle iron has a vertical extent with an inboard end perpendicularly coupled to a bottom end of the vertically oriented member and extended outwardly therefrom. Associated therewith is a horizontal extent defining an inwardly extending ledge. Also included is truss having a first end coupled to an outboard end of the angle iron and a second end coupled to a top end of the vertically oriented member. A vertical slot is formed in the vertically oriented member adjacent the top end thereof. A foot is integrally coupled to the horizontal extent of the angle iron adjacent the inboard end thereof. Such foot extends inwardly from the respective angle iron with a pad lining a bottom surface thereof. Next provided is a pair of ears each having an L-shaped configuration. Each ear is defined by a first plate and second plate. The second plate is integrally coupled perpendicularly with respect to the first plate. Further, the second plate has a lip extending therefrom in a direction opposite from that which the first plate extends. In use, the first plate of each ear is coupled on opposite sides of a window with padding situated therebetween. As such, the second plate extends outwardly from a wall in which the window resides and the lip extends inwardly towards the window. By this structure, the slots of the suspenders may be engaged with the lips of the ears such that the feet of the suspenders rest on a window stool. As shown in FIGS. 1 and 2, an extendible support plate assembly is provided including a pair of rectilinear plates. Such plates include a rectilinear first plate with a top face, a bottom face, a front face, and a rear face defining a pair of open ends. Also included is a rectilinear second plate with a top face, a front face, and a rear face defining a pair of open ends and an open bottom. Formed on the top face of both plates is a plurality of linearly aligned apertures. Preferably, such apertures are located adjacent the associated front face of the plates. During use of the present invention, the second plate may be slidably inserted within the first plate such that at least one of the apertures of each plate are aligned thereby allowing the securement of the relative positions of the plates via a pin. Note FIG. 2. This allows the support plate assembly to be supported by the ledges of the suspenders.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new window shelf apparatus and method which has many of the advantages of the window shelves mentioned heretofore and many novel features that result in a new window shelf which is not anticipated, rendered obvious, suggested, or even implied by any of the prior art window shelves, either alone or in any combination thereof.

It is another object of the present invention to provide a new window shelf which may be easily and efficiently manufactured and marketed.

It is a further object of the present invention to provide a new window shelf, which is of a durable and reliable construction.

An even further object of the present invention is to provide a new window shelf which is susceptible of a low cost of manufacture with regard to both materials and labor, and which accordingly is then susceptible of low prices of sale to the consuming public, thereby making such window shelf economically available to the buying public.

Still yet another object of the present invention is to provide a new window shelf which provides in the apparatuses and methods of the prior art some of the advantages thereof, while simultaneously overcoming some of the disadvantages normally associated therewith.

Still another object of the present invention is to provide a new window shelf for allowing the installation of a window shelf from within a house and does not inflict damage by way of tools or fasteners on the window.

Even still another object of the present invention is to provide a new window shelf that includes a pair of suspenders each with a horizontally oriented member coupled to a respective side of a window. Coupled to the horizontally oriented member is a truss. Next provided is a support plate assembly including a pair of extendible plates. In use, such support plate assembly is engaged with the suspenders for supporting an air conditioner thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view of the present invention taken along line 3—3 shown in FIG. 1.

FIG. 4 is a top view of the present invention in position in a window opening.

DESCRIPTION OF THE PREFERRED EMBODIMENT

Figure 1:
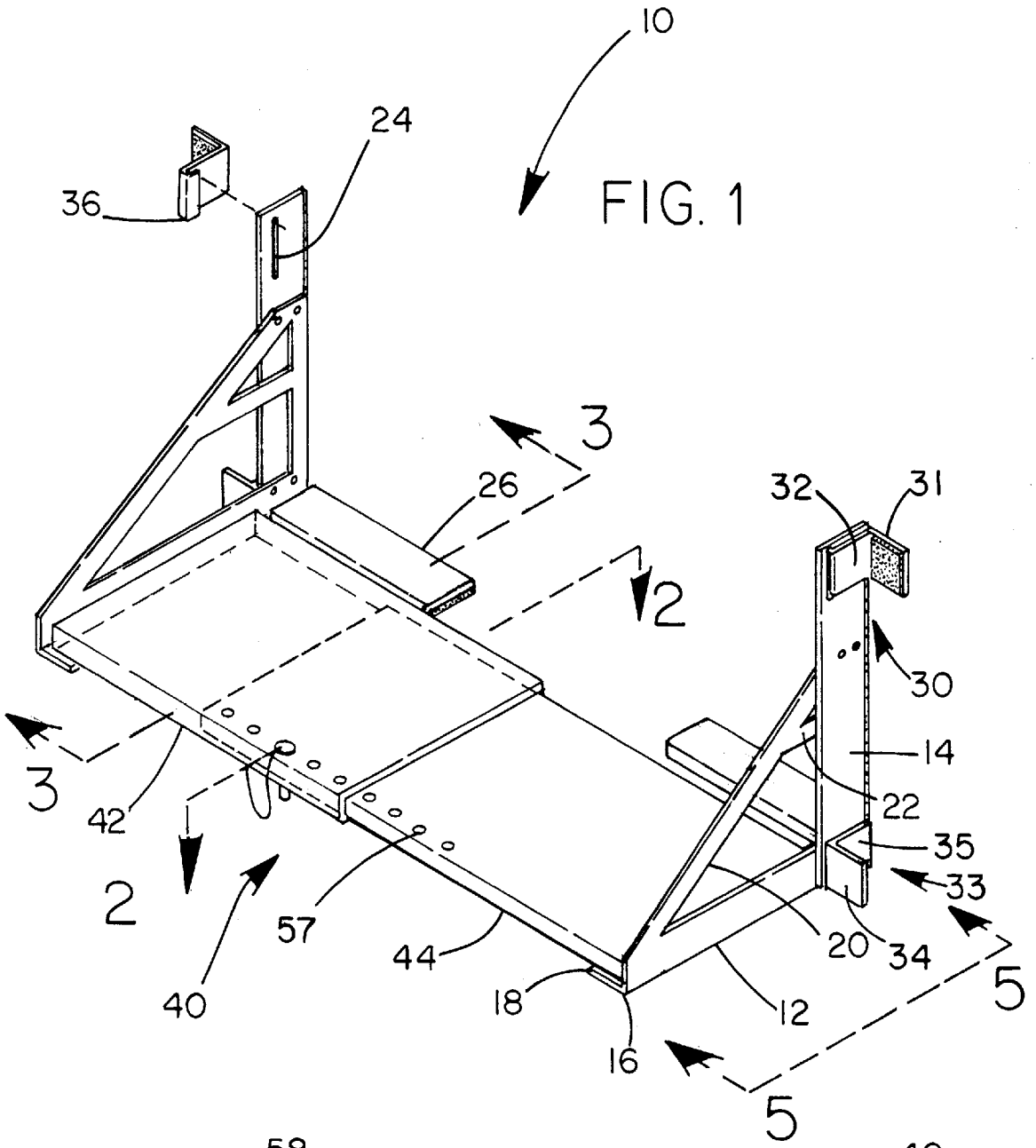
FIG. 1 is a perspective view of a new window shelf according to the present invention.

With reference now to the drawings, a new window shelf embodying the principles and concepts of the present invention and generally designated by the reference numeral 10 will be described.

As shown in FIGS. 1, 3, 5, and 5A, a pair of suspenders 12 are provided each including a planar vertically oriented member 14 and a horizontally oriented member in the form of an angle iron 16. The angle iron 16 has a vertical extent with an inboard end perpendicularly coupled to a bottom end of the vertically oriented member 14 and extended outwardly therefrom. Integrally coupled thereto is a horizontal extent defining an inwardly extending ledge 18. Also included is a truss 20 having a first end coupled to an outboard end of the angle iron 16 and a second end coupled to a top end of the vertically oriented member 14. At a point along the length of the truss, there is preferably a horizontal cross bar 22 connected between the truss and the vertically oriented member. A vertical slot 24 is formed in the vertically oriented member 14 adjacent the top end thereof. A foot 26 is integrally coupled to the horizontal extent of the angle iron 16 adjacent the inboard end thereof. Such foot 26 extends inwardly from the respective angle iron with a pad 28 lining a bottom surface thereof.

Next provided is a pair of ears 30 each having an L-shaped configuration. Each ear 30 is defined by a first plate 31 and second plate 32. The second plate 32 is integrally coupled perpendicularly with respect to the first plate 31. Further, the second plate 32 has a lip 36 extending therefrom in a direction opposite from that which the first plate 31 extends. As shown in FIG. 1, such lip 36 also has an L-shaped cross-sectional configuration.

Figure 5:
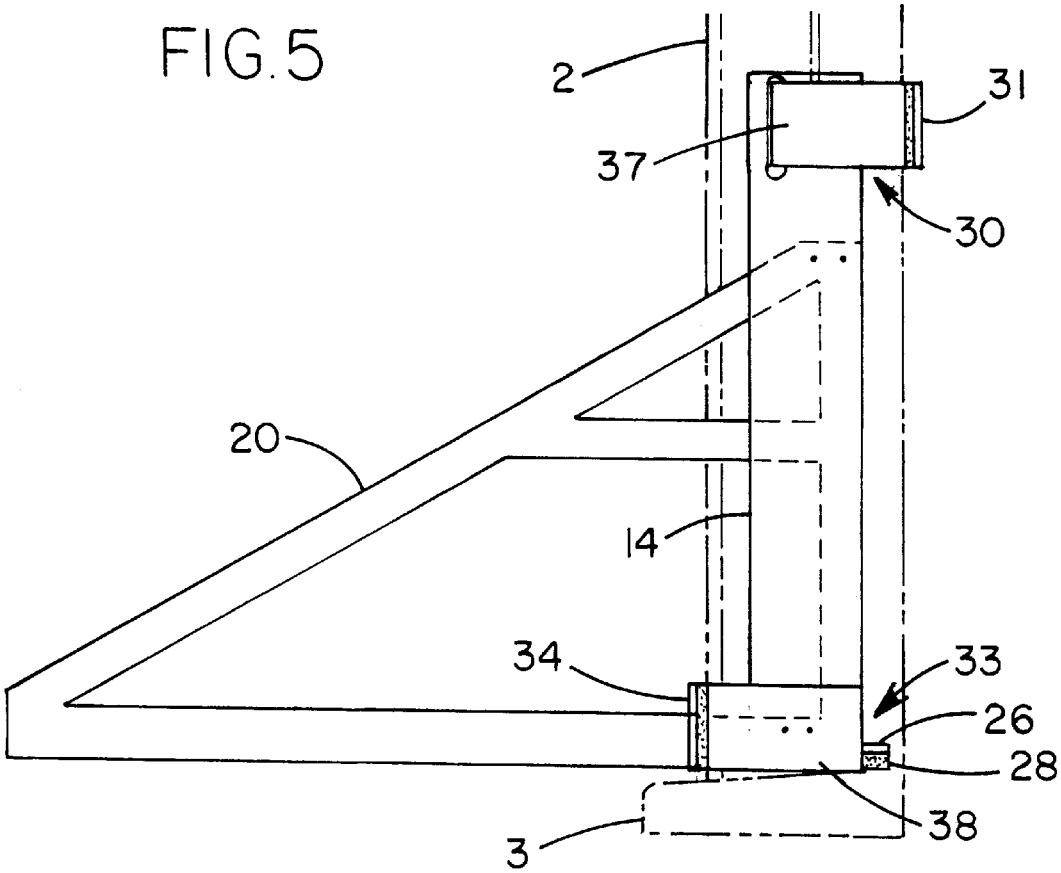
FIG. 5 is a side view showing elongated pairs of ears for a window having a thicker frame taken along line 5—5 shown in FIG. 1.
Figure 5A:
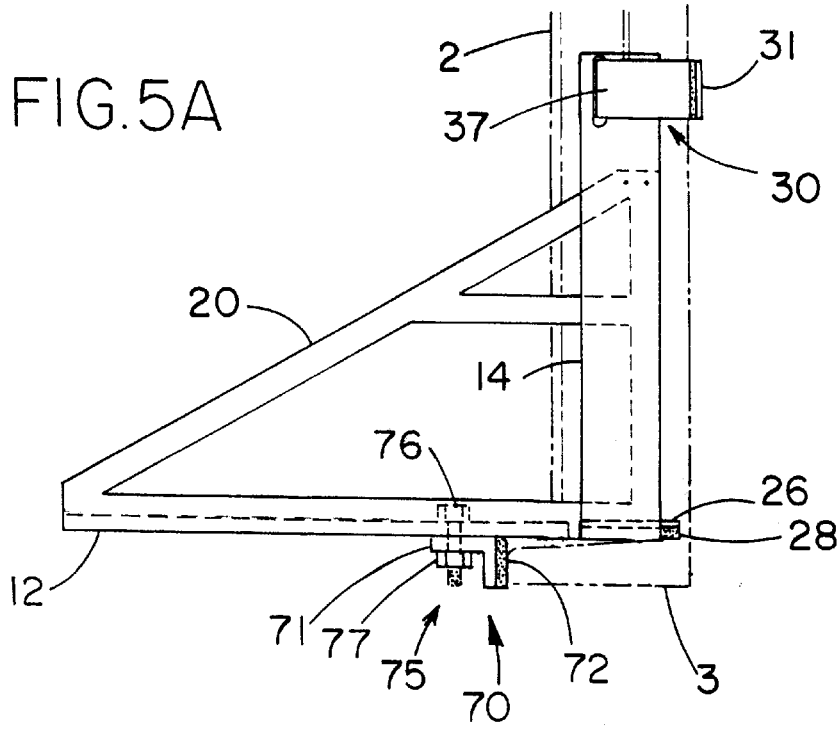
FIG. 5A is a side view showing an elongated ear and an alternate support mechanism for a window having a thicker frame taken along line 5—5 shown in FIG. 1.

In FIG. 5 and FIG. 5A an alternate embodiment for a window having a thicker frame is illustrated. The thicker window frame is accommodated by elongating a second plate 37 and a base plate 38. FIG. 5 shows these elongated plates being used for both upper and lower ears. FIG. 5A discloses the upper pair of ears using the elongated second plate 37 in combination with a constructed support member 70 which abuts against the outer sill of the window frame, and counters the force of the weight of the shelf 10 from rotating about the upper ear 30. The constructed support member 70 comprises an angle support 71, a brace plate 72, and a fastening mechanism 75. The fastening mechanism 75 is most preferably a threaded fastener 76 and a threaded closure 77 having a hand tightening means. However, other fastening and closure mechanisms could be chosen.

In use, the first plate 31 of each ear 30 is coupled on opposite sides of a window 2 with adding situated therebetween. Such coupling is preferably afforded along an interior surface of a wall in which the window 2 resides. While the coupling of the ears 30 to the wall may be accomplished with adhesives or the like, it should be understood that the mere abutment of the ears 30 therewith is sufficient for safe use, as will become apparent. The second plate 32 of each ear 30 thus extends outwardly from the inner surface of the wall and the lip 36 extends inwardly towards the window 2. By this structure, the slots 24 of the suspenders 12 may be engaged with the lips 36 of the ears 30 such that the feet 26 of the suspenders 12 rest on a window stool 3.

Figure 2:
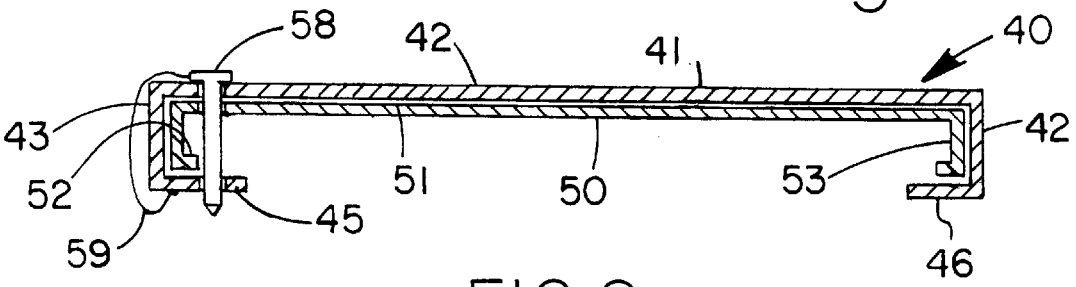
FIG. 2 is a cross-sectional view of the present invention taken along line 2—2 shown in FIG. 1.
Figure 2A:
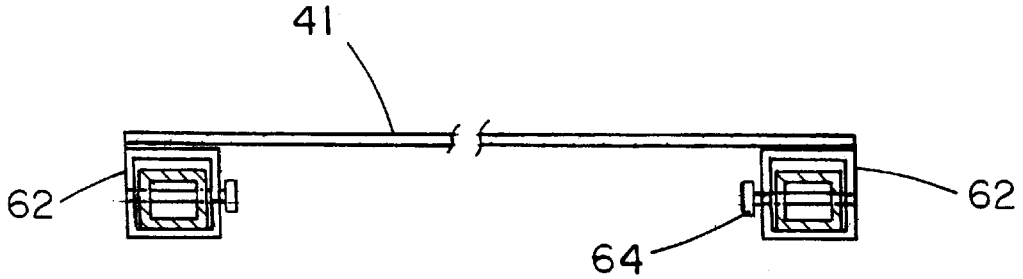
FIG. 2A is a cross-sectional view of an alternate embodiment taken along line 2A—2A in FIG. 4A of the present invention.

Preferably, as shown in FIGS. 1 and 2A, a pair of angle brackets 33 are provided each having a wall plate 34 and a base plate 35 in an L-shaped configuration. A wall plate 34 and a base plate 35 are integrally coupled perpendicularly with respect to each other. The base plate 35 is coupled to the bottom end of the vertically oriented member 14. The wall plate 34 is coupled to the exterior surface of a wall with padding situated therebetween. In use, the angle brackets 33 further aid in supporting the window shelf 10 by abutting against the exterior surface of the wall further reducing the load on the supporting members of the window shelf 10. Optionally, the elements of the pair of ears 30 may be rotated to permit attachment of the ears to the window stool 3.

More preferably, each angle bracket 33 is detachable from the vertically oriented member 14 in a manner as stated above. The base plate 35 has a lip (not shown) extending in a direction opposite from that which the wall plate 34 extends. The lip also has an L-shaped configuration and extends inwardly towards the window 2. The lip engages a slot (not shown) located near the bottom of the vertically oriented member 14 to secure the angle bracket 33 thereto.

It should be understood that the padding associated with the feet 26 and the ears 30 is designed to abate any vibration transferred from the suspenders 12 to the wall and further prevent damage to the house. As an option, various other areas of the present invention which engage the house may be padded. For example, as shown in FIG. 1, the rear edge of the vertically oriented member 14 may be padded.

As shown in FIGS. 1 and 2, an extendible support plate assembly 40 is provided including a pair of rectilinear plates. Such plates include a rectilinear first plate 41 with a top face 42, a front face 43, and a rear face 44 defining a pair of open ends and an open bottom. A front horizontal extent extends inwardly from the front face 43 parallel with the top face 42. In a similar fashion, a rear horizontal extent also extends from the rear face 44 and parallel with the top face 42. Also included is a rectilinear second plate 50 with a top surface 51, a front surface 52, and a rear surface 53 defining a pair of open ends and an open bottom. The rectilinear second plate 50 is disposed within the open bottom of the rectilinear first plate 41 so as to be slidably inserted within the rectilinear first plate 41. The front and rear horizontal extents support the rectilinear second plate 50. Formed on the top face of both plates 42, 51 and through the front horizontal extent is a plurality of linearly aligned apertures 57. Preferably, such apertures 57 are located adjacent the associated front face of the plates.

During use of the present invention, the second plate 50 may be slidably inserted within the first plate 41 such that at least one of the apertures 57 of each plate is aligned thereby allowing the securement of the relative positions of the plates via a pin 58. Ideally, the pin is connected to one of the plates by way of a small chain 59. Note FIG. 2. The foregoing structure allows the support plate assembly 40 to be supported by the ledges 18 of the suspenders 12 so that an air conditioner may be positioned thereon. In the preferred embodiment, the feet 26 each extend a length ½ that of each plate.

Figure 4A:
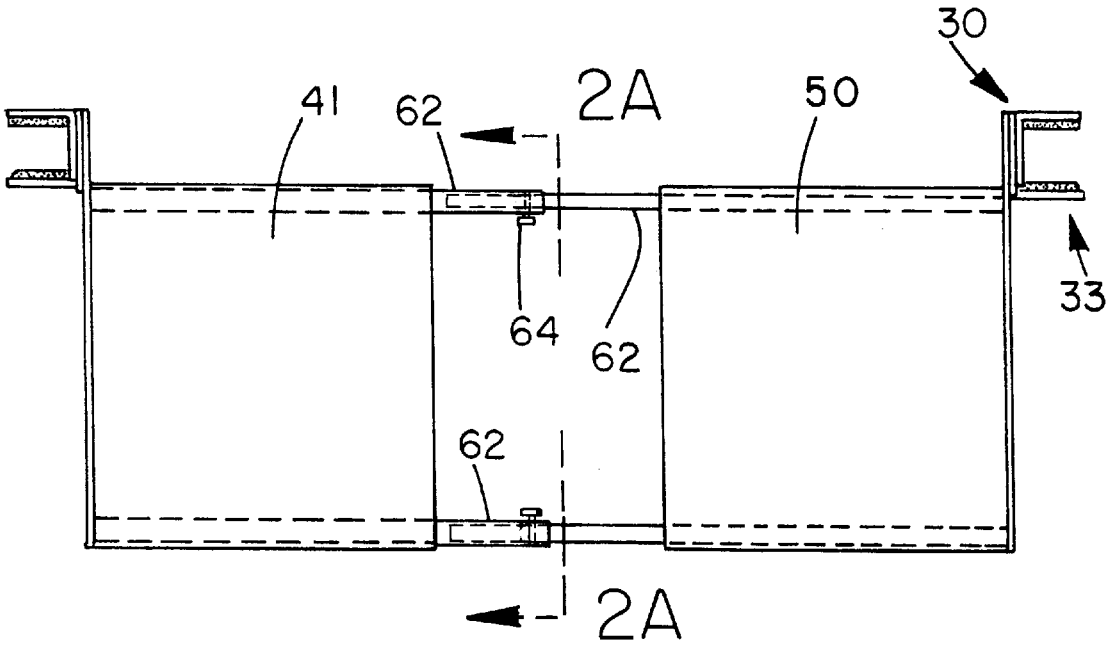
FIG. 4A is a top view of the alternate embodiment of the present invention.

In an alternate embodiment, the support plates each include a pair of rectilinear steel shafts 62 coupled to the bottom face thereof, as shown in FIGS. 2A and 4A. It should be understood that the steel shafts of each plate may be telescopingly engaged with those of the other plate such that the relative position of the plates may be adjusted. A locking pin and aperture combination 64 may be situated on the shafts for locking the relative position thereof. Once such position is locked, the plates may be positioned on the ledges for use. In yet another alternate embodiment, the plates of the support plate assembly may be fixedly coupled to the horizontally oriented member of the respective suspender thus making the suspenders and support plate assembly a unitary device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support system comprising, in combination:

a pair of suspenders each including a vertically oriented member, a horizontally oriented angle iron having a vertical extent with an inboard end perpendicularly coupled to a bottom end of the vertically oriented member and extended outwardly therefrom and a horizontal extent defining an inwardly extending ledge, a truss having a first end coupled to an outboard end of the angle iron and a second end coupled to a top end of the vertically oriented member, a vertical slot formed in the vertically oriented member adjacent the top end thereof, a vertical slot formed in the vertically oriented member adjacent the bottom end thereof, and a foot integrally coupled to the horizontal extent of the angle iron adjacent the inboard end thereof and extending inwardly therefrom with a pad lining a bottom surface thereof;

a pair of ears each having an L-shaped configuration with a first plate and second plate integrally coupled perpendicularly with respect to the first plate, the second plate having a lip extending therefrom in a direction opposite from that which the first plate extends, the first plate of each ear coupled on opposite sides of a window with padding situated therebetween such that the second plate extends outwardly from a wall in which the window resides and the lip extends inwardly towards the window, whereby the slots of the suspenders may be engaged with the lips of the ears such that the feet of the suspenders rest on a window stool;

a pair of angle brackets each having an L-shaped configuration with a wall plate and a base plate integrally coupled perpendicularly with respect to the wall plate, the base plate having a lip extending therefrom in a direction opposite from that which the wall plate extends, the lip extends inwardly toward the window, whereby the slots of the suspenders may be engaged with the lips of the ears, the base plate of each angle bracket coupled to the bottom end of the vertically oriented member, the wall plate of each angle bracket coupled to the exterior surface of a wall with padding situated therebetween; and an extendible support plate assembly including a rectilinear first plate with a top face, a front face, and a rear face defining a pair of open ends and an open bottom, a front horizontal extent extending inwardly from the front face, a rear horizontal extent extending inwardly from the rear face, the support plate assembly further including a rectilinear second plate with a top face, a front face, and a rear face defining a pair of open ends and an open bottom, the top face of both plates and the front horizontal extent having a plurality of linearly aligned apertures formed therein adjacent the associated front face, whereby the second plate may be slidably inserted within the first plate such that at least one of the apertures of each plate are aligned thereby allowing the securement of the relative positions of the plates via a pin thus allowing the support plate assembly to be supported by the ledges of the suspenders.

2. An air conditioner support system comprising:

a pair of suspenders each including a vertically oriented member, a horizontally oriented member, a truss having a first end coupled to an outboard end of the horizontally oriented member and a second end coupled to the vertically oriented member, and a foot integrally coupled to the horizontally oriented member adjacent the inboard end thereof;

a pair of ears each having an L-shaped configuration with a first plate and second plate integrally coupled perpendicularly with respect to the first plate, the first plate of each ear abutting a wall on opposite sides of a window such that the second plate extends outwardly from a wall in which the window resides, whereby the suspenders are coupled to the second plate of the ears such that the feet of the suspenders rest on a window stool of the window;

a pair of angle brackets each having an L-shaped configuration with a wall plate and a base plate integrally coupled perpendicularly with respect to the wall plate, the base plate of each angle bracket coupled to the vertically oriented member, the wall plate of each angle bracket abutting the exterior surface of a wall; and a support plate assembly coupled between the horizontally oriented members of the suspenders for supporting an air conditioner thereon.

3. An air conditioner support system as set forth in claim 2 wherein the support plate assembly includes a pair of extendible plates.

4. An air conditioner support system as set forth in claim 2 wherein the ears and feet have pads situate thereon for insulating the coupling from vibration thereof to the wall and window stool, respectively.

5. An air conditioner support system comprising:

a pair of suspenders each including a vertically oriented member and a horizontally oriented member coupled to a bottom end of the vertically oriented member, each horizontally oriented member having an inboard end for resting on a window sill of a window, each vertically oriented member having an ear extending outwardly therefrom for engaging an inner side portion of the window; and a support plate assembly including a pair of extendible plates, whereby the support plate assembly are engaged with the suspenders for supporting an air conditioner thereon.

6. An air conditioner support system as set forth in claim 5 wherein the support plate assembly includes a first plate with a top face, a front face, and a rear face defining a pair of open ends, the support plate assembly further including a rectilinear second plate with a top face, a front face, and a rear face, whereby the second plate may be slidably inserted within the first plate.

7. An air conditioner support system as set forth in claim 6 wherein the top face of both plates having a plurality of linearly aligned apertures formed therein adjacent the associated front face, whereby the second plate may be slidably inserted within the first plate such that at least one of the apertures of each plate are aligned thereby allowing the securement of the relative positions of the plates via a pin.

8. An air conditioner support system as set forth in claim 5 wherein the support plates each include a pair of rectilinear steel shafts coupled to the bottom face thereof, whereby the steel shafts of each plate are telescopingly engaged with those of the other plate such that the relative position of the plates may be adjusted.

9. An air conditioner support system as set forth in claim 5 wherein the ears are removably coupled to the suspenders.

10. An air conditioner support system as set forth in claim 5 wherein the ears are positioned at top ends of the vertically oriented members.

11. An air conditioner support system as set forth in claim 5 wherein the feet are padded for insulation purposes.

* * * * *